United States Patent [19]

Harbison

[11] Patent Number: 4,718,917

[45] Date of Patent: Jan. 12, 1988

[54] MULTICOLOR PACKAGE DYEING

[75] Inventor: John Harbison, La Grange, Ga.

[73] Assignee: West Point Pepperell, Inc., West Point, Ga.

[21] Appl. No.: 788,410

[22] Filed: Oct. 17, 1985

[51] Int. Cl.[4] ..... D06B 5/18

[52] U.S. Cl. ..... 8/149; 8/155.1

[58] Field of Search ..... 68/189; 8/155.1, 149, 8/148; 242/167, 166

[56] References Cited

U.S. PATENT DOCUMENTS

| | | | |
|---|---|---|---|
| 305,935 | 9/1884 | Landis | 242/167 |
| 956,284 | 4/1910 | Chaffee | 242/167 |
| 1,468,994 | 9/1923 | Cook | 242/167 |
| 1,613,707 | 1/1927 | Johnston | 8/149 |
| 1,724,015 | 8/1929 | Gere | 8/149 |
| 2,084,134 | 6/1937 | Dunkerke | 242/167 |
| 2,277,574 | 3/1942 | Abbott | 242/166 X |
| 2,904,984 | 9/1959 | Riba | 68/189 X |
| 3,581,528 | 6/1971 | Mortensen | 68/189 |
| 4,063,888 | 12/1977 | O'Connell et al. | 8/149 |

OTHER PUBLICATIONS

H. Marsden, "Winding Yarns for Package Dyeing", The Textile Manufacture, (Jan. 1953), 3–7.

*Primary Examiner*—Timothy F. Simone
*Assistant Examiner*—Frankie L. Stinson
*Attorney, Agent, or Firm*—Cushman, Darby & Cushman

[57] ABSTRACT

A process for package dyeing yarn is disclosed. Yarn is wound on a tube having perforations along a portion of its length. The density of the yarn package is such that when dye liquor is circulated from the interior of the tube, through the perforations and then through the yarn, its path of flow is different from when dye is circulated in the opposite direction. By circulating and absorbing dyes of different colors in each direction, multicolored dyeing of the yarn is achieved.

2 Claims, 1 Drawing Figure

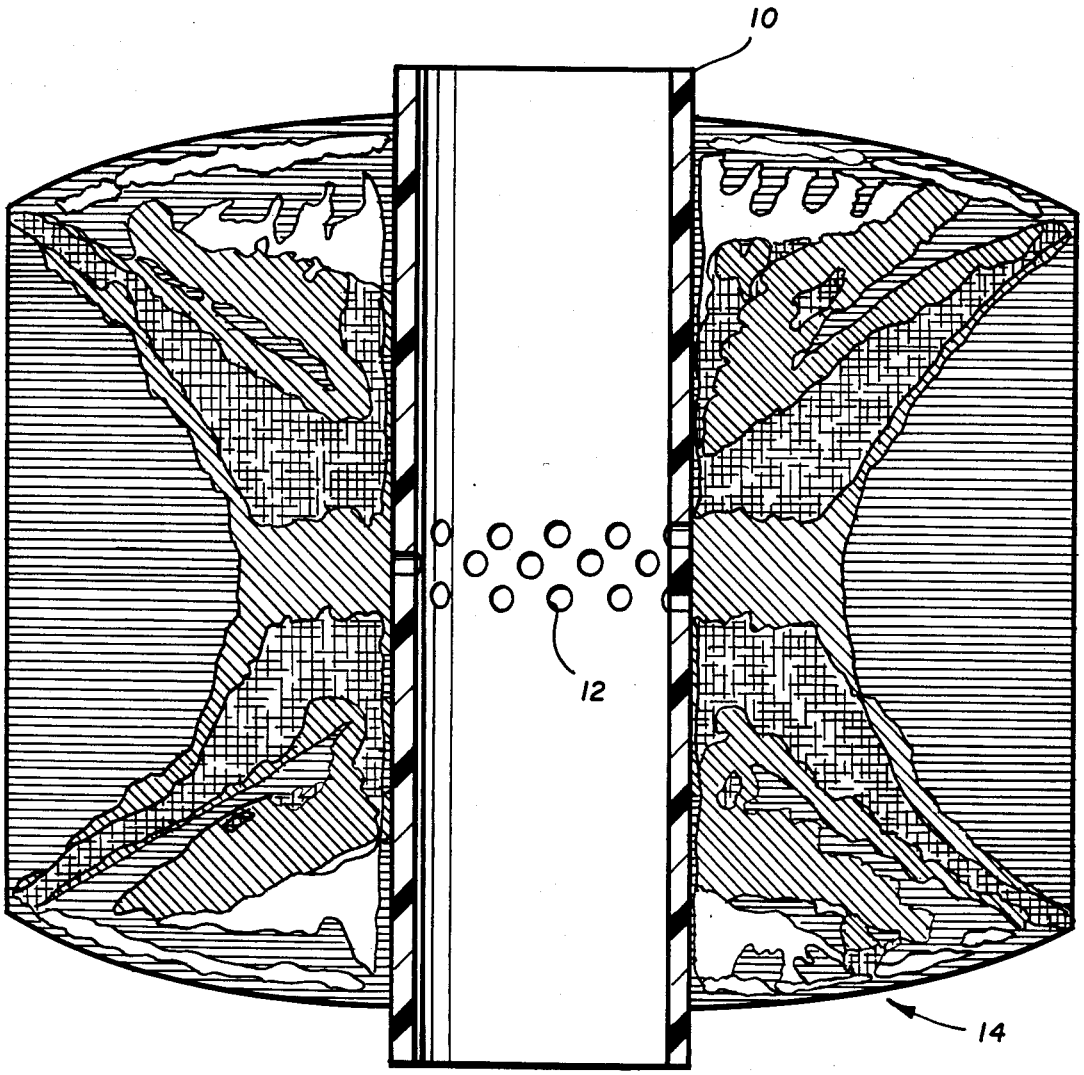
10
12
14

MULTICOLOR PACKAGE DYEING

BACKGROUND OF THE INVENTION

The present invention relates to a process for package dyeing yarn which then can be processed into a fabric having a random, multicolored effect.

U.S. Pat. No. 4,063,888, which issued on Dec. 20, 1977, describes a process for selectively package dyeing yarn. More particularly, yarn is wound about a perforated tube and is placed in a conventional package dyeing machine. Dye liquor is selectively directed from within the tube through the perforations to penetrate the package of wound yarn, and from outside the package through the yarn and the perforations to the interior of the tube. In order to obtain non-uniform dyeing, a selected array of perforations is employed to channel the flow of dye into and out of the tube, and the outside of the yarn package is masked in relation to the pattern of the selected perforations. Consequently, dye passes through a common path regardless of its direction of flow, and its movement through certain portions of the yarn package is prevented by the perforation selection and masking. This produces what is called spacedyeing—the intermittent coloring of the yarn package.

SUMMARY OF THE INVENTION

A significant shortcoming of the process disclosed in U.S. Pat. No. 4,063,888 is overcome in accordance with the present invention. More particularly, instead of causing a yarn to be intermittently dyed and not dyed, the process disclosed and claimed herein produces a yarn which is splash dyed, i.e., it is multicolored substantially throughout the yarn package with only a limited number of undyed areas.

The improved result is achieved by winding yarn as an unmasked package onto a tube having a limited number of perforations, the density of the yarn package being higher than normally employed in a package dyeing operation. As a result, dye liquor directed onto the outside of the yarn package will flow to the interior of the tube in a different path from the flow of dye from the tube's interior towards the outside of the package. When a dye of a first color is passed in one direction through the package and is absorbed by the yarn in a predetermined amount, a differently colored dye is then added to the dyebath and directed through the package in the opposite direction and absorbed by the yarn in a predetermined amount. The result is that the yarn package is dyed with areas having the respective original colors and blends thereof. A very limited amount of the package remains undyed. An alternative dyeing method is to drain the first dyebath after its use and then put the second color on the yarn from a newly made up dyebath, especially if the second color comprises a different class of dyestuff. Also, the second color can be identical to the first except for a difference in the amount of dye absorbed in the opposing flow directions, whereby a tone-on-tone color effect.is created.

DETAILS OF THE INVENTION

The invention will be described in greater detail with respect to the abcompanying drawing which illustrates in section a perforated tube with a yarn package wound thereon.

In a conventional package dyeing operation, yarn is wound about a tube which is perforated along virtually its entire length. Dye liquor is circulated first in one direction from the interior of the tube through the perforations and the yarn package, and then in the opposite direction so as to uniformly color the yarn throughout the package.

In accordance with the present invention, however, the tube 10 illustrated in the drawing is provided with a limited number of perforations 12 grouped at a location intermediate to its ends. A yarn package 14 is wound about the tube. The number and location of these perforations can be changed from the illustration to effect different color patterns in the yarn. For example, in a less preferred embodiment of the invention, one row of perforations around the middle of the tube will give a dyed package with much more undyed area than described herein. The density of the package is selected such that dye will not flow through the yarn in the same path when the direction of dye liquor movement is reversed. Thus, when a first color is circulated in one direction and is absorbed to a predetermined amount and another color then is circulated inthe opposite direction, separate portions of the package are dyed to the respective colors used, while other portions achieved a blended color. In other words, the inside of the package is dominated by a color which differs from that dominating the outside, with a blend occurring in between. This is shown in the drawing wherein, for purposes of illustration, green dye is circulated from within the tube and blue dye is circulated in the opposite direction, the blending being shown as yellow. Of course, due to the high density of the yarn package, the flow of dye is prevented from reaching a limited number of areas, primarily near the package's edges, as shown in the unhatched portions of the drawing.

To achieve a commercially acceptable fabric, a consistent blend of inside and outside yarn package colors is required from the beginning to the end of the roll of goods produced. The manner by which this can be accomplished now will be described.

Following the dyeing operation, the dye packages are paired, and each dye package is subdivided into an equal number of equal sized units. These units are either conventional knitting cones, when one is making knit goods, or conventional devices for warp and/or filling yarn when one is making woven goods.

For example, the preferred embodiment of the subdivision for knit goods is as follows:

1. Yarn from the first of a pair of dye packages is wound onto a first pair of knitting cones, half of the yarn being wound on the first cone and half on the second; and 2. Yarn from a second of the pair of dye packages is first fully wound onto an intermediate device and then is transferred to a second pair of knitting cones, half of the yarn being wound on the first of the cones of the second pair and half on the second cone. By this subdivision, yarn from a pair of dye packages is separated into equal quantities arranged on the four knitting cones as follows:

1. the outside of the first dye package is wound to the inside of the first knitting cone,and the outside of the first cone contains the middle of the package;

2. the middle of the first package is wound to the inside of the second cone, and the outside of the second cone contains the inside of the package;

3. the inside of the second dye package ends up on the inside of the third cone, and the outside of the third cone contains the middle of the package; and 4. the middle of the second package ends up on the inside of the fourth cone, and the outside of the fourth cone contains the outside of the package.

When an equal number of each of the cones so wound are fed to a knitting machine in a controlled pattern, a commercially acceptable uniform distribution of the multicolors is achieved in the fabric.

It has been stated that in order to achieve a desired color distribution throughout the yarn package, the density of the yarn on the perforated tube must be greater than customarily used in conventional package dyeing operations. No quantitative definition of the required density is possible since this is a function of such factors as the type of yarn involved, its denier, its twist, the configuration of the tube's perforations and the like. Therefore, the density must be determined for each application to satisfy the condition that the dye flow differently through the yarn depending upon whether the flow originates within the perforated tube or outside of the yarn package.

What is claimed is:

1. A process for package dyeing yarn in multicolors comprising:

winding the yarn as a package on a tube perforated along only a portion of its length, said yarn being wound at a density sufficient to cause dye liquor to flow through the package in different paths when circulated in a first direction from the interior of the tube through the perforations and then the yarn, and when circulated in a second direction from outside the package through the entire area of the yarn at the outside of the package and then through the perforations to the interior of the tube;

circulating dye liquor of one color through the package in one of said directions and allowing it to absorb to a predetermined amout; and circulating dye liquor of the same or of another color through the package in the other of said directions and allowing it to absorb to a predetermined amount.

2. A process for package dyeing yarn in multicolors comprising:

a. winding the yarn as a first package on a first tube perforated along only a portion of its length, said yarn being wound at a density sufficient to cause dye liquor to flow through the package in different paths when circulated in a first direction from the interior of the tube through the perforations and then the yarn, and when circulated in a second direction from outside the package through the yarn and then the perforations to the interior of the tube;

b. circulating dye liquor of one color through the package in one of said directions and allowing it to absorb to a predertermined amount;

c. circulating dye liquor of the same or another color through the package in the other of said directions and allowing it to absorb to a predetermined amount;

d. repeating steps a–c with yarn being wound on a second tube to form a second like package; and e. removing the dyed yarn from the respective perforated tubes of said two like packages and winding the yarn on four yarn receiving devices as follows:

i. beginning with the outside of said first package, winding yarn onto the first device, the winding continuing until the middle of the first package is reached;

ii. beginning with the middle of the first package, winding yarn onto the second device, the winding continuing until the remainder of the first package is wound thereon;

iii. winding all the yarn from the second package onto an intermediate yarn-receiving device;

iv. beginning with that portion of the second package wound onto the outside of the intermediate device, winding yarn onto the third device, the winding continuing until the middle of the yarn wound on the intermediate device is reached; and v. beginning with the middle of the yarn wound on the intermediate device, winding the yarn onto the fourth device, the winding continuing until the remainder of the yarn on the intermediate device is wound thereon.

* * * * *